US009500145B2

(12) United States Patent
Zhu et al.

(10) Patent No.: US 9,500,145 B2
(45) Date of Patent: Nov. 22, 2016

(54) EGR COOLER CONDITION MODULE AND ASSOCIATED SYSTEM

(75) Inventors: Jie Zhu, Columbus, IN (US); Linsong Guo, Columbus, IN (US)

(73) Assignee: Cummins IP, Inc., Minneapolis, MN (US)

( * ) Notice: Subject to any disclaimer, the term of this patent is extended or adjusted under 35 U.S.C. 154(b) by 627 days.

(21) Appl. No.: 13/601,506

(22) Filed: Aug. 31, 2012

(65) Prior Publication Data

US 2014/0060503 A1 Mar. 6, 2014

(51) Int. Cl.

*F02D 21/08* (2006.01)
*F02M 26/49* (2016.01)
*F02M 26/23* (2016.01)

(52) U.S. Cl.

CPC ..... *F02D 21/08* (2013.01); *F02M 26/23* (2016.02); *F02M 26/47* (2016.02); *F02M 26/49* (2016.02); *F02M 26/06* (2016.02)

(58) Field of Classification Search

CPC ..... Y02T 10/121; F02B 29/0406; F02M 25/0707; F02M 25/0728; F02M 25/0731; F02M 25/0732; F02M 25/0738; F02M 26/29; F02M 26/23; F02M 26/47; F02M 26/06; F02M 26/22; F02M 26/49; F02D 21/08

USPC ..... 123/568.11–568.32; 701/108

See application file for complete search history.

(56) References Cited

U.S. PATENT DOCUMENTS

| | | | | |
|---|---|---|---|---|
| 6,085,732 | A | 7/2000 | Wang et al. | |
| 6,802,302 | B1 | 10/2004 | Li et al. | |
| 6,848,434 | B2 * | 2/2005 | Li | 123/568.12 |
| 2004/0182373 | A1 * | 9/2004 | Li | 123/568.12 |
| 2009/0249782 | A1 * | 10/2009 | Li | 60/599 |
| 2010/0051001 | A1 * | 3/2010 | Webb | 123/568.12 |
| 2011/0023839 | A1 * | 2/2011 | Styles | 123/568.12 |
| 2011/0224948 | A1 | 9/2011 | Cianflone et al. | |
| 2012/0096927 | A1 * | 4/2012 | Freund | F02B 37/005 73/31.03 |
| 2013/0312716 | A1 * | 11/2013 | Balestrino | F02D 21/08 123/568.16 |
| 2014/0020362 | A1 * | 1/2014 | Warey | F01N 3/08 60/274 |

FOREIGN PATENT DOCUMENTS

| | | |
|---|---|---|
| GB | 2347217 B | 8/2003 |

OTHER PUBLICATIONS

Styles et al., Identification and Control of Factors that Affect EGR Cooler Fouling, Diesel Engine-Efficiency and Emissions Research Conference, Dearborn, MI, Aug. 2008.

Styles et al., Factors Impacting Egr Cooler Fouling—Main Effects and Interactions, 16th Directions in Engine Efficiency and Emissions Research Conference, Detroit, MI, Sep. 2010.

* cited by examiner

*Primary Examiner* — Sizo Vilakazi
(74) *Attorney, Agent, or Firm* — Foley & Lardner LLP

(57) ABSTRACT

An apparatus for determining a condition of an exhaust gas recirculation (EGR) cooler of an internal combustion engine includes a clean EGR cooler module that is configured to estimate the temperature of exhaust gas exiting a clean EGR cooler. The apparatus also includes a fouled EGR cooler module that is configured estimate the temperature of exhaust gas exiting a fouled EGR cooler. Further, the apparatus includes an EGR cooler effectiveness module that is configured to determine a normalized effectiveness of the EGR cooler based on the estimated temperature of exhaust gas exiting a clean EGR cooler and the estimated temperature of exhaust gas exiting a fouled EGR cooler. Additionally, the apparatus includes an EGR cooler condition module that is configured to determine a condition of the EGR cooler based on the normalized effectiveness of the EGR cooler.

18 Claims, 4 Drawing Sheets

EGR COOLER CONDITION MODULE AND ASSOCIATED SYSTEM

FIELD

This disclosure relates generally to internal combustion engine systems that utilize exhaust gas recirculation (EGR) techniques, and more particularly to determining a condition of an EGR cooler of an internal combustion engine.

BACKGROUND

The use of exhaust gas recirculation (EGR) techniques to reduce the amount of nitrous oxides in exhaust gas generated by an internal combustion engine is well known in the art. Generally, EGR techniques include recirculating a portion of the exhaust gas generated by a combustion event within a combustion chamber of the engine back into the combustion chamber for a future combustion event. The recirculated exhaust gas reduces the temperature of the combustion components prior to combustions. The lower temperature of the combustion components promotes a reduction in the amount of nitrous oxides generated as a result of the combustion process.

To further reduce the temperature of the combustion components and improve the reduction of nitrous oxides in the exhaust gas, EGR coolers have been employed to cool the recirculating exhaust gas prior to entering the combustion chamber. EGR coolers also enable higher EGR flow rates into the combustion chambers of the engine. The effectiveness of an EGR cooler to reduce the temperature of exhaust gas varies based on the operating conditions of the engine system. For example, EGR cooler effectiveness tends to decrease with increased EGR flow rates. In contrast, EGR cooler effectiveness tends to increase with increased exhaust gas temperatures.

Unfortunately, EGR coolers are prone to fouling (i.e., a degradation of the condition of the EGR cooler). Fouling can occur when unburned hydrocarbons (UHC) and/or particulate matter (PM) accumulate on the walls of the EGR cooler. The deposition of UHC and PM within the EGR cooler degrades the effectiveness (e.g., the heat transfer efficiency) of the EGR cooler and obstructs the flow of exhaust through the cooler. Other factors that may promote the fouling of EGR coolers includes extreme boundary conditions (e.g., extreme exhaust gas temperatures, extreme coolant temperatures, and extreme exhaust gas flow rates), frequency and duration of operating modes of the engine (e.g., steady state, transient, and shutdowns), the design of the cooler, and chemical reactions and acids forming within the cooler. Regardless of the cause, EGR fouling degrades the effectiveness of the EGR cooler to reduce the temperature of the exhaust gas, negates the advantages of increased EGR flow provided by the cooler, and creates backpressure issues within the exhaust system. Accordingly, although the effectiveness of an EGR cooler varies based on operating conditions of the engine system, the effectiveness of the cooler at each operating condition is scaled downward when the EGR cooler is fouled.

Some prior art systems attempt to model the effectiveness of an EGR cooler based on various operating conditions. While such models may provide an estimate of the effectiveness of the EGR cooler, they fail to provide any indication of the fouling or condition of the EGR cooler. Accordingly, to identify the fouling or condition of an EGR cooler, prior art techniques include physically removing the EGR cooler from the system and visually inspecting the cooler for indications of fouling. Of course, physically removing and inspecting an EGR cooler necessitates significant vehicle downtime and labor, all of which leads to increased costs and a loss in productivity.

SUMMARY

The subject matter of the present application has been developed in response to the present state of the art, and in particular, in response to the problems and needs in the art that have not yet been fully solved by currently available EGR cooler monitoring techniques. For example, no prior art techniques are available that provide a quantitative process for continuously monitoring the fouling status or physical condition (e.g., a degradation level) of an EGR cooler without removing the EGR cooler from the engine system. Accordingly, in certain embodiments, the subject matter of the present application has been developed to provide methods and systems for continuously determining, monitoring, and reporting the fouling status of an EGR cooler in situ or during operation of the engine system. The quantitative process for determining the fouling status of the EGR cooler utilizes a normalized EGR effectiveness calculation based on predicted and measured operating conditions of the engine.

According to one embodiment, an apparatus for determining a condition of an exhaust gas recirculation (EGR) cooler of an internal combustion engine includes a clean EGR cooler module that is configured to estimate the temperature of exhaust gas exiting a clean EGR cooler. The apparatus also includes a fouled EGR cooler module that is configured to estimate the temperature of exhaust gas exiting a fouled EGR cooler. Further, the apparatus includes an EGR cooler effectiveness module that is configured to determine a normalized effectiveness of the EGR cooler based on the estimated temperature of exhaust gas exiting a clean EGR cooler and the estimated temperature of exhaust gas exiting a fouled EGR cooler. Additionally, the apparatus includes an EGR cooler condition module that is configured to determine a condition of the EGR cooler based on the normalized effectiveness of the EGR cooler.

In some implementations of the apparatus, the normalized effectiveness of the EGR cooler determined by the EGR cooler effectiveness module is based on an EGR cooler normalized effectiveness value. The EGR cooler effectiveness module can be configured to determine a plurality of EGR cooler normalized effectiveness values, where the condition of the EGR cooler is based on the plurality of EGR cooler normalized effectiveness values. The EGR cooler condition module can be further configured to store the plurality of EGR cooler normalized effectiveness values as a distribution curve with the condition of the EGR cooler corresponding with a center of the distribution curve. In certain instances, the condition of the EGR cooler is based on the position of the center of the distribution curve relative to a predetermined marker for a fouled EGR cooler and a predetermined marker for a clean EGR cooler. The EGR cooler condition module may be configured to determine the center of the distribution curve based on an averaging technique. The distribution curve can be a bell curve, and the center of the bell curve can be the approximate apex of the bell curve.

According to certain implementations of the apparatus, the EGR cooler effectiveness module determines the nor malized effectiveness of the EGR cooler based on the following equation:

$$ECE_{nom} = \left( \frac{T_{out} - T_{out_fouled}}{T_{out_clean} - T_{out_fouled}} \right)$$

where $ECE_{nom}$ is the normalized effectiveness of the EGR cooler, $T_{out}$ is a detected temperature of exhaust gas exiting the EGR cooler, $T_{out_fouled}$ is the estimated temperature of exhaust gas exiting a fouled EGR cooler, and $T_{out_clean}$ is the estimated temperature of exhaust gas exiting a clean EGR cooler.

In yet some implementations of the apparatus, the clean EGR cooler module estimates the temperature of exhaust gas exiting a clean EGR cooler by comparing a theoretical model of the effectiveness of a clean EGR cooler with a measured effectiveness of a clean EGR cooler. In contrast, the fouled EGR cooler module estimates the temperature of exhaust gas exiting a fouled EGR cooler by comparing a theoretical model of the effectiveness of a fouled EGR cooler with a measured effectiveness of a fouled EGR cooler. The condition of the EGR cooler can be represented as a percentage of at least one of fouling and freshness of the EGR cooler. The clean EGR cooler module can estimate the temperature of exhaust gas exiting a clean EGR cooler based on a theoretical model of the effectiveness of a clean EGR cooler. In contrast, the fouled EGR cooler module can estimate the temperature of exhaust gas exiting a fouled EGR cooler based on a theoretical model of the effectiveness of a fouled EGR cooler.

According to another embodiment, a method for determining a condition of an exhaust gas recirculation (EGR) cooler of an internal combustion engine includes estimating a temperature of exhaust gas exiting a clean EGR cooler and estimating a temperature of exhaust gas exiting a fouled EGR cooler. The method also includes determining a normalized effectiveness value of the EGR cooler based on the temperature of exhaust gas exiting a clean EGR cooler and the temperature of exhaust gas exiting a fouled EGR cooler. Additionally, the method includes determining a degradation level of the EGR cooler based on the normalized effectiveness value.

In some implementations, the method also includes determining whether a mass flow rate of exhaust gas through the EGR cooler is greater than a threshold. In such implementations, The actions of estimating the temperature of exhaust gas exiting a clean EGR cooler, estimating the temperature of exhaust gas exiting a fouled EGR cooler, determining the normalized effectiveness value of the EGR cooler, and determining the degradation level of the EGR cooler are performed only when the mass flow rate is determined to be greater than the threshold.

According to certain implementations, determining the normalized effectiveness value of the EGR cooler includes determining a plurality of normalized effectiveness values of the EGR cooler over time. The method determines the degradation level of the EGR cooler based on the plurality of normalized effectiveness values only when the plurality of normalized effectiveness values meets or exceeds a threshold number of normalized effectiveness values. The plurality of normalized effectiveness values can define a distribution curve and the method may include determining a center of the distribution curve. Determining the degradation level of the EGR cooler may include setting the degradation level of the EGR cooler equal to the normalized effectiveness value corresponding with a center of the distribution curve.

In some implementations of the method, the temperature of exhaust gas exiting a clean EGR cooler is estimated based on an exhaust gas flow rate through the EGR cooler, a temperature of exhaust gas entering the EGR cooler, and a temperature of coolant within the EGR cooler. In contrast, the temperature of exhaust gas exiting a fouled EGR cooler is estimated based on the exhaust gas flow rate through the EGR cooler, the temperature of exhaust gas entering the EGR cooler, and the temperature of coolant within the EGR cooler.

According to yet some implementations of the method, the temperature of exhaust gas exiting a clean EGR cooler is estimated based on at least one pre-calibrated coefficient associated with a clean EGR cooler. In contrast, the temperature of exhaust gas exiting a fouled EGR cooler is estimated based on at least one pre-calibrated coefficient associated with a fouled EGR cooler.

In certain implementations, of the method, the normalized effectiveness value is independent of the mass flow rate of exhaust gas through the EGR cooler. The normalized effectiveness value can be based solely and/or directly on the temperature of exhaust gas exiting a clean EGR cooler, the temperature of exhaust gas exiting a fouled EGR cooler, and a detected temperature of exhaust gas exiting the EGR cooler.

According to yet another embodiment, a system for determining a physical degradation of an exhaust gas recirculation (EGR) cooler includes an internal combustion engine capable of generating an exhaust gas stream, an EGR line in exhaust gas receiving communication with the exhaust gas stream, an EGR cooler positioned within the EGR line, and a controller configured to determine a physical degradation of the EGR cooler based on a normalized effectiveness of the EGR cooler. The normalized effectiveness can include a plurality of normalized effectiveness values, and the physical degradation of the EGR cooler may correspond with a center of a distribution curve defined by the plurality of normalized effectiveness values.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1:
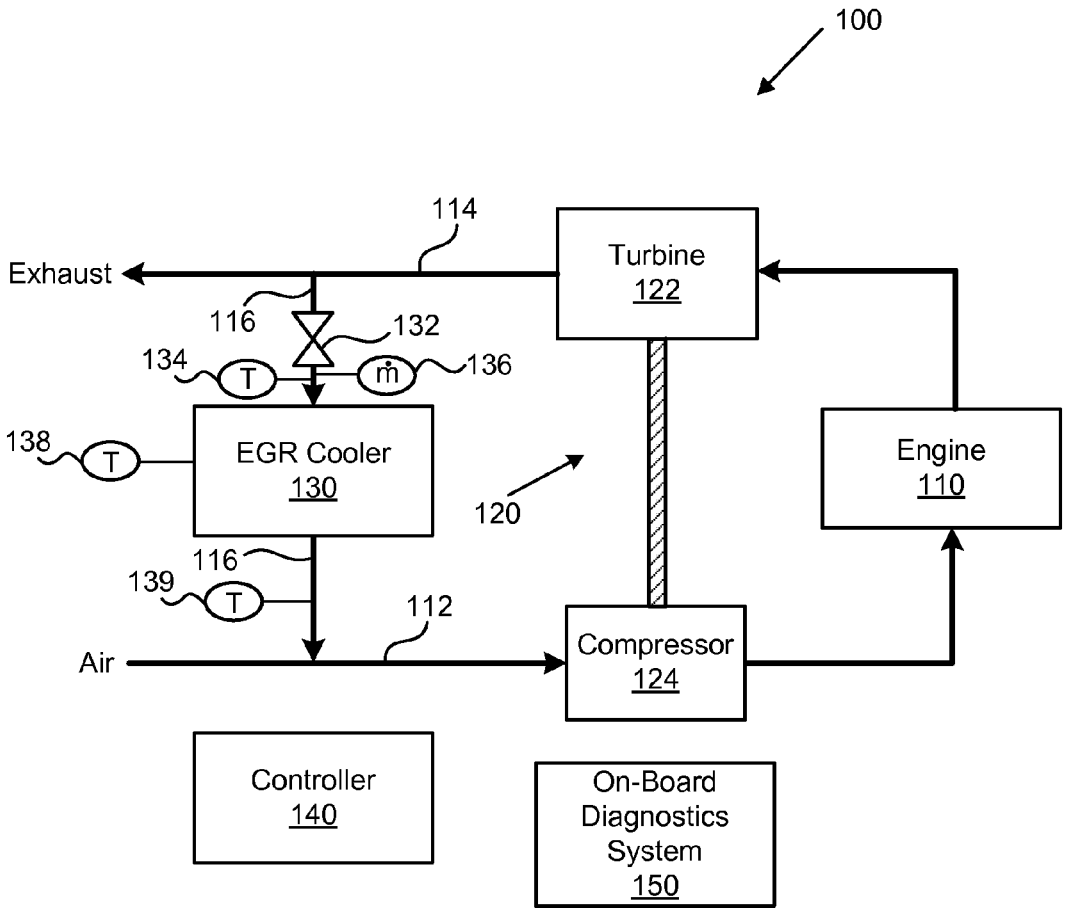
FIG. 1 is a schematic diagram of an engine system having an internal combustion engine and an exhaust gas recirculation (EGR) line with an EGR cooler according to one representative embodiment.

Referring to FIG. 1, an engine system 100 according to one embodiment includes an internal combustion engine 110, a turbocharger 120, an EGR cooler 130, and a controller 140. In some implementations, the engine system 100 also includes an on-board diagnostics (OBD) system 150. The internal combustion engine 110 can be a compression-ignited internal combustion engine, such as a diesel fueled engine, or a spark-ignited internal combustion engine, such as a gasoline fueled engine. Generally, the internal combustion engine combusts fuel in the presence of air within one or more combustion chambers. Although not shown, the engine system 100 includes a fuel source configured to provide fuel for combustion to the engine. The engine system 100 also includes an air intake system that includes an air intake line 112 that places the engine 110 in air receiving communication with an air source (e.g., atmospheric air). Combustion of the fuel and air in the combustion chamber produces exhaust gas that is operatively vented to an exhaust line 114.

Although not necessary, in some embodiments, the engine system 100 includes a turbocharger 120 powered by a portion of the exhaust gas generated by the engine 110. The turbocharger includes a turbine 122 that is co-rotably coupled with a compressor 124. The exhaust gas is used to directly power (e.g., drive or spin) the turbocharger turbine 122. The turbocharger turbine 32 then drives the turbocharger compressor 124 via the co-rotatable connection. The compressor 124 is configured to compress at least some of the air flowing through the air intake line 112 before directing the compressed air to the engine 110.

For the purposes of altering the combustion properties of the engine 110, a portion of the exhaust gas in the exhaust gas line 114 may be re-circulated back to the engine 110 via an exhaust gas recirculation (EGR) line 116. As shown, the EGR line 116 is operable to fluidly couple the exhaust line 114 with the air intake line 112 such that the re-circulated exhaust gas is added to the air in the air intake line prior to entering the engine 110. The amount (e.g., flow rate) of exhaust gas entering the EGR line 116 and added to the air intake line 112 is controlled by actuation of an EGR valve 132. Generally, the EGR valve 132 is actuated according to an EGR control signal to divert a requested amount of exhaust gas back to the engine. The requested amount of exhaust gas is determined and the EGR control signal is generated by the controller 140. The portion of the exhaust gas which is not re-circulated to the engine 110 via the EGR line 116 is destined for expulsion from the engine system 100 into the atmosphere.

Although in the illustrated embodiment, the EGR line 116 is a low-pressure EGR line positioned downstream of the turbine 122, in other embodiments, the EGR line can be a high-pressure EGR line positioned upstream of the turbine. Accordingly, in some embodiments, the EGR line 116 can bypass the turbine 122. Regardless of whether the EGR line 116 is a low-pressure or high-pressure EGR line, the EGR line includes the EGR cooler 130. Although the EGR cooler 130 is shown downstream of the EGR valve 132, in some embodiments, the EGR cooler 130 can be positioned upstream of the EGR valve 132. Generally, the EGR cooler 130 is configured to reduce the temperature of the recirculating exhaust gas flowing through the EGR line 116. In one embodiment, the EGR cooler 130 acts as a conventional heat exchanger that transfers heat from the exhaust gas to a coolant via various heat transfer modes to effectively reduce the temperature of the exhaust gas. However, the EGR cooler 130 can be any of various types of EGR coolers known in the art, such as tube-and-shell EGR coolers and fin-type EGR coolers among others. Additionally, the EGR cooler 130 can have any of various capacities and aspect ratios.

Various sensors, such as exhaust temperature sensor 134, exhaust mass flow sensor 136, coolant temperature sensor 138, exhaust temperature sensor 139, and the like, may be strategically disposed throughout the engine system 100 and may be in communication with the controller 140 to monitor operating conditions of the engine system. In one embodiment, the temperature sensor 134 is positioned upstream of the EGR cooler 130 to detect the temperature of the recirculating exhaust gas entering the EGR cooler (e.g., the EGR cooler inlet temperature 230 of FIG. 2). The mass flow sensor 136 may be positioned within the EGR line 116 (e.g., upstream of the EGR cooler 130) and configured to detect the mass flow rate of the recirculating exhaust gas through the EGR cooler (e.g., the EGR flow rate 225 of FIG. 2). The coolant temperature sensor 138 is configured to detect the temperature of the coolant flowing through the EGR cooler 130 (e.g., the coolant temperature 232. In one implementation, the coolant temperature sensor 138 is positioned to detect the temperature of the coolant entering the EGR cooler 130. In yet other implementations, the coolant temperature sensor 138 is positioned to detect the temperature of the coolant exiting the EGR cooler 130. In yet another implementation, the coolant temperature sensor 138 is positioned to detect the temperature of the coolant at a location within the EGR cooler 130. In one embodiment, the temperature sensor 139 is positioned downstream of the EGR cooler 130 to detect the temperature of the recirculating exhaust gas exiting the EGR cooler (e.g., the EGR cooler outlet temperature 234 of FIG. 2).

Notwithstanding the type of EGR cooler 130, the EGR cooler is prone to fouling. As defined herein, fouling can be defined as the degradation of the physical condition of the EGR cooler. EGR cooler fouling has a direct negative impact on the effectiveness (e.g., heat transfer efficiency) of the EGR cooler. As discussed above, current engine systems may monitor the effectiveness of an EGR cooler. However, no current engine systems monitor the fouling or physical condition of the EGR cooler without a physical inspection of the cooler. Accordingly, the controller 140 is configured to determine, monitor, and report in a continuous and real-time fashion the fouling or physical condition of the EGR cooler while operating within the engine system 100 (e.g., without removing the EGR cooler from engine system and inspecting the cooler).

Figure 2:
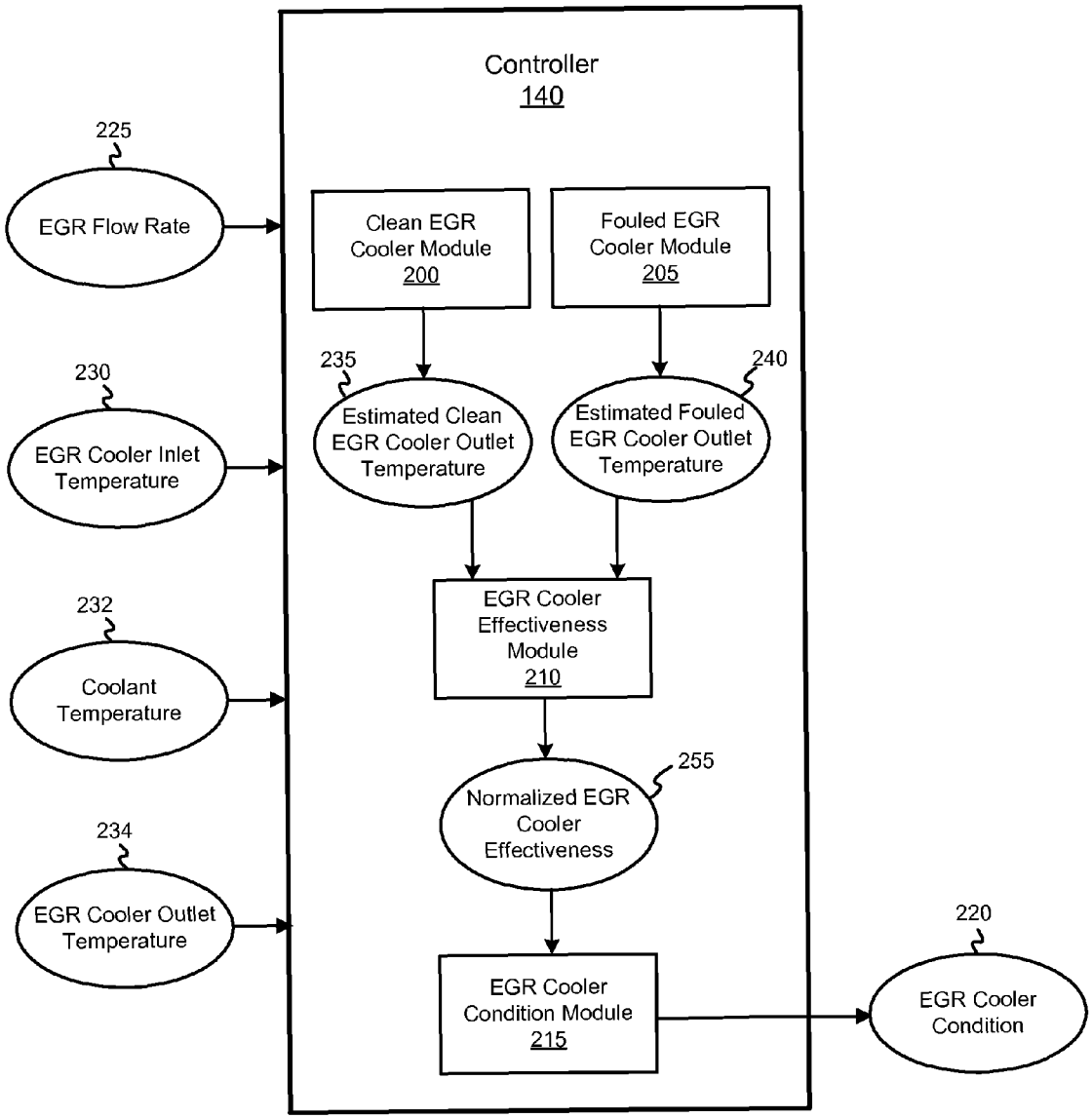
FIG. 2 is a schematic block diagram of a controller of the engine system of FIG. 1 according to one representative embodiment.

Generally, the controller 140 controls the operation of the engine system 100. The controller 140 is depicted in FIGS. 1 and 2 as a single physical unit, but can include two or more physically separated units or components in some embodiments if desired. Generally, the controller 140 receives multiple inputs, processes the inputs, and transmits multiple outputs. The multiple inputs may include sensed measurements from the sensors and various user inputs. The inputs are processed by the controller 140 using various algorithms, stored data, and other inputs to update the stored data and/or generate output values. The generated output values and/or commands are transmitted to other components of the controller and/or to one or more elements of the engine system 100 to control the system to achieve desired results. For example, in one implementation, the controller 140 may report determinations of the fouling status of the EGR cooler 130 to the OBD system 150.

The controller 140 includes various modules for controlling the operation of the engine system 100. For example, in the illustrated embodiment, the controller 140 includes a clean EGR cooler module 200, fouled EGR cooler module 205, an EGR cooler effectiveness module 210, and an EGR cooler condition module 215. While not specifically illustrated and described with reference to FIG. 2, additional controller modules for conducting other control system functions are also possible and can be considered to fall within the scope of the present disclosure. As is known in the art, the controller 140 and its various modular components may comprise processor, memory, and interface modules that may be fabricated of semiconductor gates on one or more semiconductor substrates. Each semiconductor substrate may be packaged in one or more semiconductor devices mounted on circuit cards. Connections between the modules may be through semiconductor metal layers, substrate-to-substrate wiring, or circuit card traces or wires connecting the semiconductor devices.

The clean and fouled EGR cooler modules 200, 205 are configured to determine estimated clean and fouled EGR cooler outlet temperatures 235, 240, respectively, based on theoretical and empirical models. More specifically, the modules 200, 205 compare a theoretical model with measured results to estimate the outlet temperature of the EGR cooler 130 when in a clean or fresh condition (e.g., a hypothetical clean EGR cooler), and the outlet temperature of the EGR cooler 130 when in a fully fouled condition (e.g., a hypothetical fouled EGR cooler), respectively.

According to one implementation, the theoretical (e.g., isentropic) model is expressed according to the following equation:

$$ECE = 1.0 - e^{-C_f \dot{m}^{(A_f - 1.0)} T_{in}^{(1.0 - A_f)/2.0}} \quad \text{Equation (1)}$$

where ECE is the effectiveness of the EGR cooler, $C_f$ is a first EGR cooler factor, $A_f$ is second EGR cooler factor, $T_{in}$ is the temperature of the recirculating exhaust gas entering the EGR cooler, and $\dot{m}$ is the mass flow rate of recirculating exhaust gas through the EGR cooler. In some implementations, the first and second EGR cooler factors $C_f$, $A_f$ are pre-calibrated coefficients for the particular characteristics and configurations of the engine system 100 based on experimental data. The temperature $T_{in}$ of the recirculating exhaust gas can be set equal to the EGR cooler inlet temperature 230. The EGR cooler inlet temperature 230 can be the exhaust temperature detected by the physical exhaust temperature sensor 134. Alternatively, the EGR cooler inlet temperature 230 can be determined via a virtual sensor based on a model approach. The mass flow rate $\dot{m}$ of the recirculating exhaust gas can be set equal to the EGR flow rate 225, which can be detected by the physical mass flow rate sensor 136, or determined via a virtual sensor based on a model approach. In certain implementations, the OBD system 150 may require monitoring of the flow of recirculating exhaust gas through the EGR line 116. Accordingly, the same sensor input signal from the mass flow sensor 136 utilized by the OBD system 150 for diagnostic purposes may be used by the clean and fouled EGR cooler modules 200, 205 for determining the estimated clean and fouled EGR cooler outlet temperatures 235, 340.

According to one implementation, the empirical model is expressed according to the following equation:

$$ECE = \frac{T_{in} - T_{out_est}}{T_{in} - T_{coolant}} \quad \text{Equation (2)}$$

where $T_{in}$ is the temperature of the recirculating exhaust gas entering the EGR cooler 130, $T_{out_est}$ is the estimated temperature of the recirculating exhaust gas exiting the EGR cooler, and $T_{coolant}$ is the temperature of the coolant within the EGR cooler. The EGR cooler inlet temperature $T_{in}$ can be detected by a physical sensor or determined via a virtual sensor as discussed above. The EGR coolant temperature $T_{coolant}$ can set equal to the coolant temperature 232, which can be detected by the physical temperature sensor 134 or determined via a virtual sensor based on a model approach. In some implementations, the EGR coolant temperature $T_{coolant}$ is based on one or more of a detected or estimated temperature of the coolant at the inlet, outlet, or middle of the EGR cooler 130. In the illustrated embodiment, the EGR cooler outlet temperature $T_{out_est}$ is determined by setting Equation 1 equal to Equation 2 and solving for the EGR cooler outlet temperature $T_{out_est}$. Because the determination of the EGR cooler outlet temperature $T_{out_est}$ is based at least partially on a theoretical model, the determined EGR cooler outlet temperature $T_{out_est}$ is defined as the estimated EGR cooler outlet temperature.

The clean EGR cooler module 200 determines the estimated EGR cooler outlet temperature for a clean EGR cooler by setting Equation 1 equal to Equation 2, setting the first and second EGR cooler factors $C_f$, $A_f$ equal to pre-calibrated values corresponding with operation of the engine system 100 with a clean EGR cooler, setting the mass flow rate $\dot{m}$ equal to the detected EGR flow rate 225, setting the EGR cooler inlet temperature $T_{in}$ equal to the detected EGR cooler inlet temperature 230, and setting the EGR coolant temperature $T_{coolant}$ equal to the detected coolant temperature 232. Similarly, the fouled EGR cooler module 205 determines the estimated EGR cooler outlet temperature for a completely fouled EGR cooler by setting Equation 1 equal to Equation 2, setting the first and second EGR cooler factors $C_f$, $A_f$ equal to pre-calibrated values corresponding with operation of the engine system 100 with a completely fouled EGR cooler, setting the mass flow rate $\dot{m}$ equal to the same detected EGR flow rate 225, setting the EGR cooler inlet temperature $T_{in}$ equal to the same detected EGR cooler inlet temperature 230, and setting the EGR coolant temperature $T_{coolant}$ equal to the same detected coolant temperature 232. Although the values will vary from engine type, duty cycle, calibration, and other engine characteristics, in one particular implementation, the pre-calibrated first and second EGR cooler factors $C_f$, $A_f$ associated with a clean EGR cooler are 0.07837 and 0.53012, respectively, and the pre-calibrated first and second EGR cooler factors $C_f$, $A_f$ associated with a fully fouled EGR cooler are 0.04876 and 0.5258, respectively. In one embodiment, the sets of first and second EGR cooler factors $C_f$, $A_f$ are set equal to an approximation of the slope of a curve fit of experimentally-obtained test cell data for clean and fully fouled EGR coolers, respectively.

Based on the estimated clean and fouled EGR cooler outlet temperatures 235, 240, the EGR cooler effectiveness module 210 determines a normalized EGR cooler effectiveness 255 for the operating EGR cooler 130. According to one implementation, the EGR cooler effectiveness module 210 determines the normalized EGR cooler effectiveness 255 according to the following equation:

$$ECE_{nom} = \left(\frac{T_{out} - T_{out_fouled}}{T_{out_clean} - T_{out_fouled}}\right) * 100\% \qquad \text{Equation (3)}$$

where $T_{out}$ is the temperature of the recirculating exhaust gas exiting the EGR cooler 130 (e.g., EGR cooler outlet temperature 234), $T_{out_fouled}$ is the estimated temperature of the recirculating exhaust gas exiting a completely fouled EGR cooler (e.g., the estimated fouled EGR cooler outlet temperature 240), and $T_{out_clean}$ is the estimated temperature of the recirculating exhaust gas exiting a clean or fresh EGR cooler (e.g., the estimated clean EGR cooler outlet temperature 235). Accordingly, Equation 3 relies on an effectiveness ratio of the EGR cooler that is independent of the flow of exhaust gas through the EGR line 116. In other words, although exhaust mass flow information may be needed for calculating the normalized EGR cooler effectiveness, the calculated normalized EGR cooler effectiveness facilitates the determination of the condition of the EGR cooler without referring to the exhaust mass flow. The EGR cooler outlet temperature 234 can be the temperature detected by the physical temperature sensor 139 or determined via a virtual sensor based on a model approach. In certain implementations, the OBD system 150 may require monitoring of the temperature of recirculating exhaust gas exiting the EGR cooler 130. Accordingly, the same sensor input signal from the EGR outlet temperature sensor 139 utilized by the OBD system 150 for diagnostic purposes may be used by the EGR cooler effectiveness module 210 for determining the normalized EGR cooler effectiveness 255.

Figure 3:
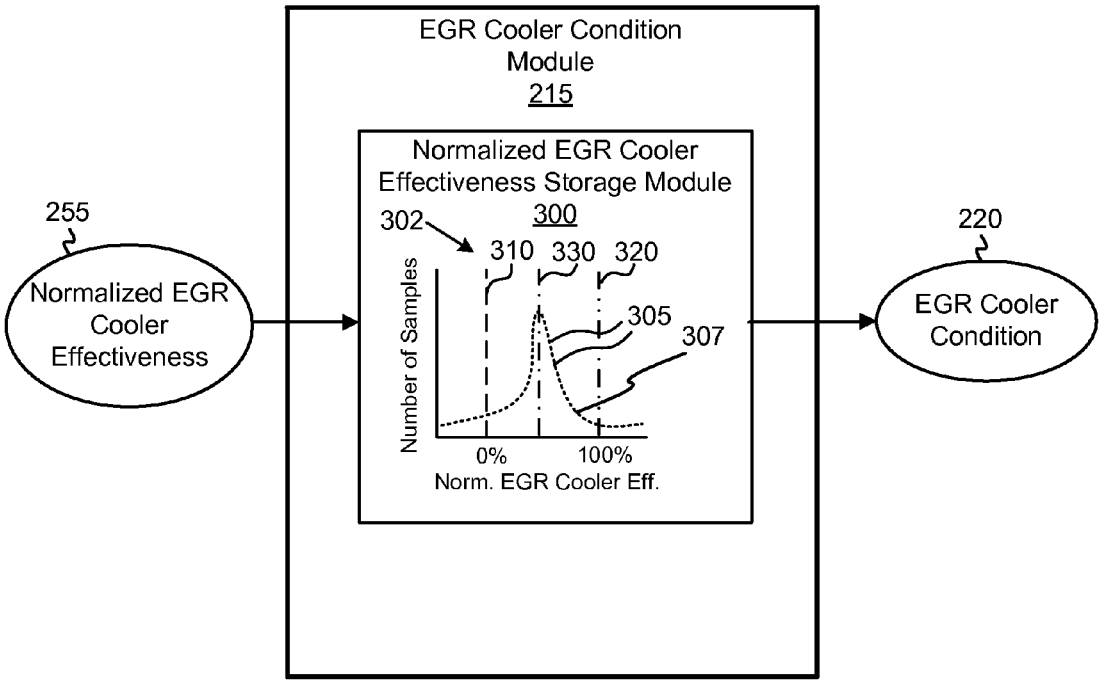
FIG. 3 is a schematic block diagram of an EGR cooler condition module of the controller of FIG. 2 in accordance with one representative embodiment.

The normalized EGR cooler effectiveness 255 determined by the EGR cooler effectiveness module 210 is communicated to the EGR cooler condition module 215. Based on a set of normalized EGR cooler effectiveness values 305 received from the EGR cooler effectiveness module 210 over time, the EGR cooler condition module 215 determines the EGR cooler condition 220. Referring to FIG. 3, according to one embodiment, the EGR cooler condition module 215 includes a normalized EGR effectiveness storage module 300 that stores a plurality of normalized EGR cooler effectiveness values 305 taken at various times and operating conditions according to a desired sampling rate. The plurality of values 305 are stored and plotted 302 against the number of samples corresponding with the values to create a distribution curve or histogram 307 representing a normal distribution of normalized EGR cooler effectiveness values. Over time, with at least a threshold number of stored normalized EGR cooler effectiveness values 305, the distribution curve 307 forms a bell-like curve with a determinable center (e.g., approximate apex of the bell-like curve) associated with a corresponding normalized EGR cooler effectiveness value. The center can be determined using any of various averaging techniques, such as calculating the basic average, mean, and/or median of the stored values 305. Additionally, or alternatively, in some embodiments, the center can be determined from the distribution curve 307 by utilizing interpolation techniques.

In the illustrated embodiment, the determined center of the distribution curve 307 is indicated by line 330, which corresponds with an associated normalized EGR cooler effectiveness value on the x-axis of the plot 302. The normalized EGR cooler effectiveness value associated with the center line 330 is set as the EGR cooler condition 220 and can be any of various percentages between a 0% freshness or effectiveness percentage indicated by boundary line or marker 310 and a 100% freshness or effectiveness percentage indicated by boundary line or marker 320. The 0% effectiveness percentage corresponds with a completely fouled EGR cooler and the 100% effectiveness percentage corresponds with a completely fresh or clean EGR cooler. In certain embodiments, the normalized EGR cooler effectiveness percentage is determined using interpolation techniques using the 0% and 100% effectiveness percentages as boundary conditions.

The 0% and 100% effectiveness percentage center lines 310, 320 can be predetermined from experimentally-obtained test cell data for fully fouled and clean EGR coolers, respectively, using a fixed number N of samples in a buffer. For example, in a test cell environment with an engine system having an EGR cooler known to be clean, a distribution curve similar to curve 307 can be obtained, and a center of the distribution curve can be determined and assigned as the 100% clean or effectiveness boundary line 320. Likewise, in the same test cell environment, the engine system can be operated with an EGR cooler that is known to be completely fouled. The determined center of the distribution curve obtained from the test results can be assigned as the 0% clean or effectiveness boundary line 310. However, in practice, the tested EGR cooler that is assumed to be completely fouled actually may not be completely fouled. Accordingly, the 0% clean boundary line 310 may require further calibration and adjustment, either lower or higher, based on actual engine system performance in the field.

Although the condition indicators illustrated in FIG. 3 and associated with the EGR cooler condition 220 are represented as percent freshness or effectiveness values, other condition indicators can be used without departing from the essence of the present disclosure. In other words, the EGR cooler condition 220 can be any of various indicators, other than percent freshness or effectiveness, representing a condition of the EGR cooler 130. For example, in some embodiments, the condition indicator can be represented as a percent fouled value, or a degradation level (e.g., degradation percentage) of the EGR cooler. In other embodiments, the condition indicator can be represented as another scaled numerical value or an alphanumeric description of the status, such as fully fouled, fresh EGR, or any of various descriptions representing conditions between fully fouled and clean (e.g., partially fouled, medium fouled, highly fouled, slightly fouled, properly functioning, improperly functioning, etc.). In some embodiments, the EGR cooler condition 220 is communicated to the OBD system 150 of the engine system 100. The OBD system 150 may communicate the EGR cooler condition 220 to a user of the engine system 100 via any of various types of alerts, such as visual and aural alerts as is known in the art.

Figure 4:
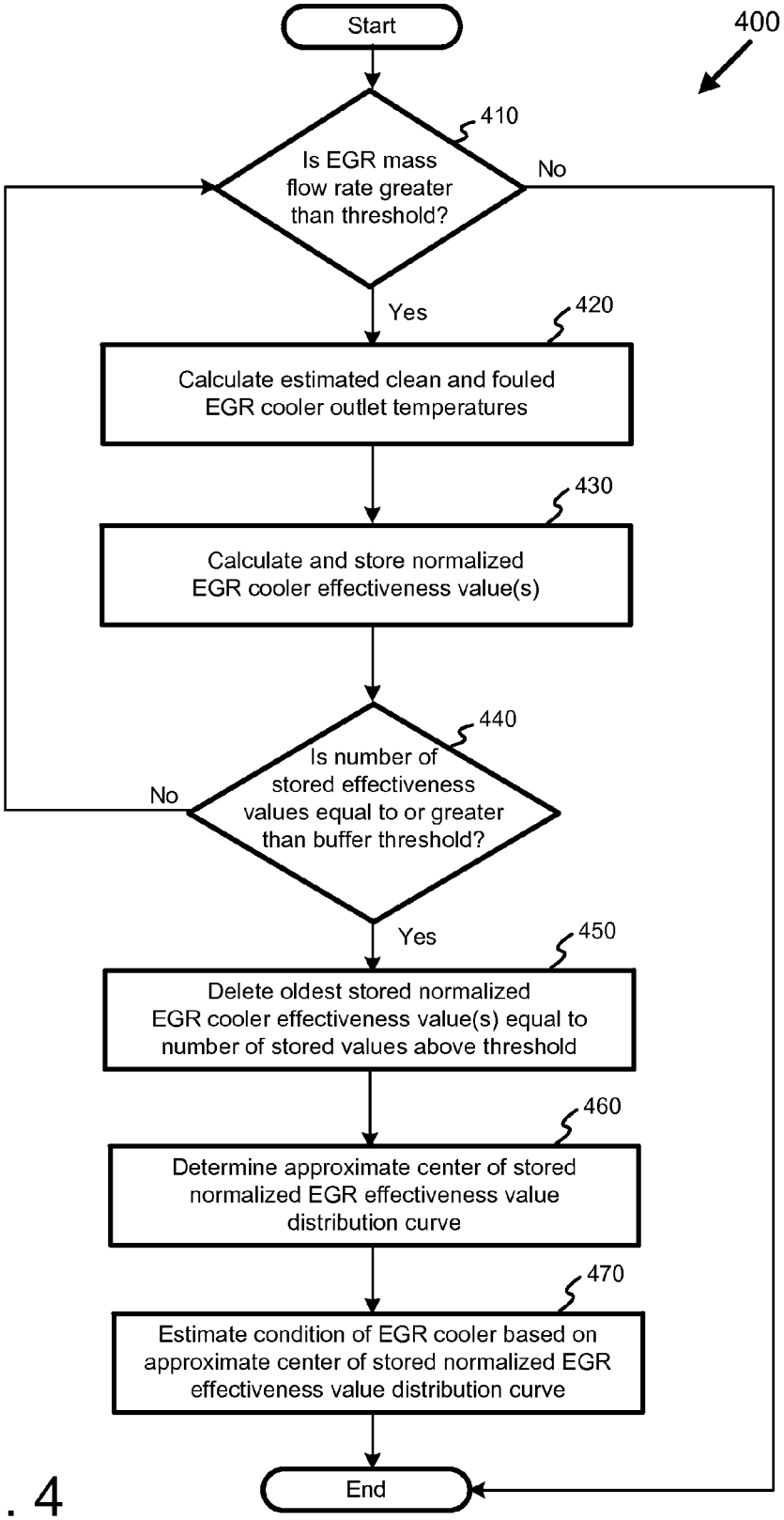
FIG. 4 is a schematic flow chart diagram of a method for determining a fouling status or condition of an EGR cooler according to one representative embodiment.

In operation, such as during regular operation of the engine system 100 in the field, the controller 140 is operable to continuously determine EGR cooler conditions in real-time and, in some implementations, continuously report the determined EGR cooler conditions in real-time. According to one embodiment, the controller 140 and its associated modules executes a method 400 shown in FIG. 4. The method 400 includes determining whether an EGR mass flow rate (e.g., exhaust flow rate through the EGR line 116) is greater than a mass flow rate threshold at 410. The EGR mass flow rate can be detected by physical sensors (e.g., sensor 136) or via a virtual sensor. Further, the mass flow rate threshold can be pre-calibrated based on the configuration of the engine system and EGR cooler. Generally, the mass flow rate threshold is associated with a minimum threshold for which accurate normalized EGR cooler effectiveness values are obtainable. In one particular implementation, the mass flow rate threshold is about 0.5 kg/min. If the EGR mass flow rate is below the threshold, then the method 400 ends. However, if the EGR mass flow rate is equal to or above the threshold then the method 400 proceeds to calculate estimated clean and fouled EGR cooler outlet temperatures (e.g., estimated temperatures 235, 240) at 420. Calculation of the estimated clean and fouled EGR cooler outlet temperatures at 420 may include comparing an equation (e.g., Equation 1) representing a theoretical model of the effectiveness of an EGR cooler with an equation (e.g., Equation 2) representing a measured effectiveness of the EGR cooler.

Based on the estimated clean and fouled EGR cooler outlet temperatures calculated at 420, the method 400 calculates and stores normalized EGR cooler effectiveness values at 430. In one implementation, calculation of the normalized EGR cooler effectiveness values at 430 includes incorporating the estimated clean and fouled EGR cooler outlet temperatures into an equation (e.g., Equation 3) representing the normalized EGR cooler effectiveness. The normalized EGR cooler effectiveness provides a much more convenient and accurate metric for determining and monitoring the EGR cooler condition compared to regular or non-normalized EGR cooler effectiveness metrics.

After a new normalized EGR cooler effectiveness value (or set of new values) is calculated and stored at 430, the method 400 determines whether the number of stored normalized EGR cooler effectiveness values is greater than a buffer threshold at 440. The buffer threshold of stored normalized EGR cooler effectiveness values is set to ensure that there are enough data points to produce an accurate and robust distribution curve for determining the EGR cooler condition. Further, the buffer threshold is a fixed number of samples equal to the number of samples in the buffer used to determine the pre-calibrated 0% and 100% effectiveness percentage center lines 310, 320. The buffer threshold can be pre-calibrated and fixed based on the configuration of the engine system 100. Alternatively, the buffer threshold number can be pre-calibrated based on the configuration of the engine system 100, but adjustable based on actual performance of the engine system in operation. In one particular implementation, the buffer threshold number of stored normalized EGR cooler effectiveness values is at least about 10,000. If the number of stored normalized EGR cooler effectiveness values does not exceed the threshold number at 440, then the method 400 returns to repeat steps 410-440. However, if the number of normalized EGR cooler effectiveness values exceeds the threshold number at 440, then, in certain implementations, to ensure the number of values in the buffer equals the buffer threshold, the method 400 deletes a number of the oldest stored normalized EGR cooler effectiveness values equal to the number of stored values above the buffer threshold at 450. Accordingly, in certain implementations, once an initial execution of steps 450, 460, and 470 is performed, the number of the oldest stored normalized EGR cooler effectiveness values deleted at 450 will be equal to the number of newly stored EGR cooler effectiveness values at 430, which can be one newly stored value or a set of newly stored values.

After the oldest normalized EGR cooler effectiveness values are deleted from the buffer of stored values at 450, the method 400 determines the center of a distribution curve defined by the stored normalized EGR cooler effectiveness values at 460. The formation of the distribution curve can be accomplished using techniques that are the same as or analogous to those utilized by the controller 140 as described above. The center of the distribution curve determined at 460 can be an approximate or estimated center of the distribution curve, and need not be an exact center of the curve. For example, in some implementations, any of various averaging techniques can be used to determine the approximate center of the distribution curve.

The method 400 further includes estimating the condition of the EGR cooler based on the approximate center of the distribution curve at 470 in a manner similar to or analogous to the EGR cooler condition module 215 described above. In certain implementations, estimating the condition of the EGR cooler includes setting the condition of the EGR cooler equal to the EGR condition indicator associated with the center line of the distribution curve relative to the fully fouled and clean boundary lines. For example, if the center line of the distribution curve is about half way between the fully fouled and clean boundary lines, then the estimated condition of the EGR cooler is set to 50% clean or 50% fouled depending on a desired viewpoint. Of course, the center line of the distribution curve can fall on any of an infinite number of percentages between, and including, 0% clean and 100% clean.

Although not shown, the method 400 may include reporting the estimated condition of the EGR cooler to an OBD system, a database, or other data gathering repository. Further in some implementations, the relative timing of the normalized EGR cooler effectiveness values may also be tracked and stored. Accordingly, the rate (e.g., slope) of degradation of the EGR cooler may be determined by calculating a ratio of the difference of estimated EGR cooler degradation values (over a time period) to the time period. In some implementations, the OBD system may alert a user if the rate of degradation of the EGR cooler exceeds a threshold, which may indicate the EGR cooler is experiencing a catastrophic failure or abnormal dysfunction.

The schematic flow chart diagrams and method schematic diagrams described above are generally set forth as logical flow chart diagrams. As such, the depicted order and labeled steps are indicative of representative embodiments. Other steps, orderings and methods may be conceived that are equivalent in function, logic, or effect to one or more steps, or portions thereof, of the methods illustrated in the schematic diagrams.

Additionally, the format and symbols employed are provided to explain the logical steps of the schematic diagrams and are understood not to limit the scope of the methods illustrated by the diagrams. Although various arrow types and line types may be employed in the schematic diagrams, they are understood not to limit the scope of the corresponding methods. Indeed, some arrows or other connectors may be used to indicate only the logical flow of a method. For instance, an arrow may indicate a waiting or monitoring period of unspecified duration between enumerated steps of a depicted method. Additionally, the order in which a particular method occurs may or may not strictly adhere to the order of the corresponding steps shown.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions, which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of computer readable program code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. Where a module or portions of a module are implemented in software, the computer readable program code may be stored and/or propagated on in one or more computer readable medium(s).

The computer readable medium may be a tangible computer readable storage medium storing the computer readable program code. The computer readable storage medium may be, for example, but not limited to, an electronic, magnetic, optical, electromagnetic, infrared, holographic, micromechanical, or semiconductor system, apparatus, or device, or any suitable combination of the foregoing.

More specific examples of the computer readable medium may include but are not limited to a portable computer diskette, a hard disk, a random access memory (RAM), a read-only memory (ROM), an erasable programmable read-only memory (EPROM or Flash memory), a portable compact disc read-only memory (CD-ROM), a digital versatile disc (DVD), an optical storage device, a magnetic storage device, a holographic storage medium, a micromechanical storage device, or any suitable combination of the foregoing. In the context of this document, a computer readable storage medium may be any tangible medium that can contain, and/or store computer readable program code for use by and/or in connection with an instruction execution system, apparatus, or device.

The computer readable medium may also be a computer readable signal medium. A computer readable signal medium may include a propagated data signal with computer readable program code embodied therein, for example, in baseband or as part of a carrier wave. Such a propagated signal may take any of a variety of forms, including, but not limited to, electrical, electro-magnetic, magnetic, optical, or any suitable combination thereof. A computer readable signal medium may be any computer readable medium that is not a computer readable storage medium and that can communicate, propagate, or transport computer readable program code for use by or in connection with an instruction execution system, apparatus, or device. Computer readable program code embodied on a computer readable signal medium may be transmitted using any appropriate medium, including but not limited to wireless, wireline, optical fiber cable, Radio Frequency (RF), or the like, or any suitable combination of the foregoing.

In one embodiment, the computer readable medium may comprise a combination of one or more computer readable storage mediums and one or more computer readable signal mediums. For example, computer readable program code may be both propagated as an electro-magnetic signal through a fiber optic cable for execution by a processor and stored on RAM storage device for execution by the processor.

Computer readable program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The computer readable program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. An apparatus for determining a condition of an exhaust gas recirculation (EGR) cooler of an internal combustion engine, comprising:

a clean EGR cooler module configured to estimate the temperature of exhaust gas exiting a clean EGR cooler based on a pre-calibrated coefficient associated with a clean EGR cooler, wherein the pre-calibrated coefficient associated with the clean EGR cooler is determined based on a detected mass flow rate of exhaust gas through the EGR cooler, a detected EGR cooler inlet temperature, and a detected EGR coolant temperature;

a fouled EGR cooler module configured to estimate the temperature of exhaust gas exiting a fouled EGR cooler based on a pre-calibrated coefficient associated with a fouled EGR cooler, wherein the pre-calibrated coefficient associated with the fouled EGR cooler is determined based on the detected mass flow rate of exhaust gas through the EGR cooler;

an EGR cooler effectiveness module configured to determine a normalized effectiveness of the EGR cooler based on a temperature of exhaust gas through the EGR cooler with the estimated temperature of exhaust gas exiting a clean EGR cooler and the estimated temperature of exhaust gas exiting a fouled EGR cooler, wherein the normalized effectiveness of the EGR cooler is determined without direct use of the detected mass flow rate of exhaust gas; and an EGR cooler condition module configured to determine a condition of the EGR cooler based on the normalized effectiveness of the EGR cooler, wherein an alert is provided to a user based on the determined condition of the EGR cooler.

2. The apparatus of claim 1, wherein the normalized effectiveness of the EGR cooler determined by the EGR cooler effectiveness module comprises an EGR cooler normalized effectiveness value, wherein the EGR cooler effectiveness module is configured to determine a plurality of EGR cooler normalized effectiveness values, and wherein the condition of the EGR cooler is based on the plurality of EGR cooler normalized effectiveness values.

3. The apparatus of claim 2, wherein the EGR cooler condition module is further configured to store the plurality of EGR cooler normalized effectiveness values as a distribution curve, and wherein the condition of the EGR cooler corresponds with a center of the distribution curve.

4. The apparatus of claim 3, wherein the condition of the EGR cooler is based on the position of the center of the distribution curve relative to a predetermined marker for a fouled EGR cooler and a predetermined marker for a clean EGR cooler.

5. The apparatus of claim 3, wherein the EGR cooler condition module is configured to determine the center of the distribution curve based on an averaging technique.

6. The apparatus of claim 3, wherein the distribution curve comprises a bell curve, and the center of the bell curve comprises the approximate apex of the bell curve.

7. The apparatus of claim 1, wherein the EGR cooler effectiveness module determines the normalized effectiveness of the EGR cooler based on the following equation:

$$ECE_{nom} = \frac{T_{out} - T_{out_fouled}}{T_{out_clean} - T_{out_fouled}}$$

where $ECE_{nom}$ is the normalized effectiveness of the EGR cooler, $T_{out}$ is a detected temperature of exhaust gas exiting the EGR cooler, $T_{out_fouled}$ is the estimated temperature of exhaust gas exiting a fouled EGR cooler, and $T_{out_clean}$ is the estimated temperature of exhaust gas exiting a clean EGR cooler.

8. The apparatus of claim 1, wherein:

the clean EGR cooler module estimates the temperature of exhaust gas exiting a clean EGR cooler by comparing a theoretical model of the effectiveness of a clean EGR cooler with a measured effectiveness of a clean EGR cooler; and the fouled EGR cooler module estimates the temperature of exhaust gas exiting a fouled EGR cooler by comparing a theoretical model of the effectiveness of a fouled EGR cooler with a measured effectiveness of a fouled EGR cooler.

9. The apparatus of claim 1, wherein the condition of the EGR cooler comprises a percentage of at least one of fouling and freshness of the EGR cooler.

10. The apparatus of claim 1, wherein:

the clean EGR cooler module estimates the temperature of exhaust gas exiting a clean EGR cooler based on a theoretical model of the effectiveness of a clean EGR cooler; and the fouled EGR cooler module estimates the temperature of exhaust gas exiting a fouled EGR cooler based on a theoretical model of the effectiveness of a fouled EGR cooler.

11. A method for determining a condition of an exhaust gas recirculation (EGR) cooler of an internal combustion engine, comprising:

estimating a temperature of exhaust gas exiting a clean EGR cooler based on a pre-calibrated coefficient associated with a clean EGR cooler, wherein the pre-calibrated coefficient associated with the clean EGR cooler is determined based on a detected mass flow rate of exhaust gas through the EGR cooler, a detected EGR cooler inlet temperature, and a detected EGR coolant temperature;

estimating a temperature of exhaust gas exiting a fouled EGR cooler based on a pre-calibrated coefficient associated with a fouled EGR cooler, wherein the pre-calibrated coefficient associated with the fouled EGR cooler is determined based on the detected mass flow rate of exhaust gas through the EGR cooler;

determining a normalized effectiveness value of the EGR cooler based on a temperature of exhaust gas through the EGR cooler with the temperature of exhaust gas exiting a clean EGR cooler and the temperature of exhaust gas exiting a fouled EGR cooler, wherein the normalized effectiveness of the EGR cooler is determined without direct use of the detected mass flow rate of exhaust gas;

determining a degradation level of the EGR cooler based on the normalized effectiveness value; and selectively alerting a user based on the determined degradation level of the EGR cooler.

12. The method of claim 11, further comprising determining whether a mass flow rate of exhaust gas through the EGR cooler is greater than a threshold, wherein the actions of estimating the temperature of exhaust gas exiting a clean EGR cooler, estimating the temperature of exhaust gas exiting a fouled EGR cooler, determining the normalized effectiveness value of the EGR cooler, and determining the degradation level of the EGR cooler are performed only when the mass flow rate is determined to be greater than the threshold.

13. The method of claim 11, wherein determining a normalized effectiveness value of the EGR cooler comprises determining a plurality of normalized effectiveness values of the EGR cooler over time, and wherein the method determines the degradation level of the EGR cooler based on the plurality of normalized effectiveness values only when the plurality of normalized effectiveness values exceeds a threshold number of normalized effectiveness values.

14. The method of claim 13, wherein the plurality of normalized effectiveness values defines a distribution curve when plotted against EGR cooler degradation level values, the method further comprising determining a center of the distribution curve, and wherein determining the degradation level of the EGR cooler comprises setting the degradation level of the EGR cooler equal to the EGR cooler degradation level value corresponding with a center of the distribution curve.

15. The method of claim 11, wherein:

the temperature of exhaust gas exiting a fouled EGR cooler is estimated based on the temperature of exhaust gas entering the EGR cooler and the temperature of coolant within the EGR cooler.

16. The method of claim 11, wherein the normalized effectiveness value is based solely on the temperature of exhaust gas exiting a clean EGR cooler, the temperature of exhaust gas exiting a fouled EGR cooler, and a detected temperature of exhaust gas exiting the EGR cooler.

17. A system for determining a physical degradation of an exhaust gas recirculation (EGR) cooler, comprising:

an internal combustion engine capable of generating an exhaust gas stream;

an EGR line in exhaust gas receiving communication with the exhaust gas stream;

an EGR cooler positioned within the EGR line; and a controller configured to determine a physical degradation of the EGR cooler based on a normalized effectiveness of the EGR cooler, wherein the normalized effectiveness is based on a temperature of exhaust gas through the EGR cooler with an estimated temperature of exhaust gas exiting a clean EGR cooler and an estimated temperature of exhaust gas exiting a fouled EGR cooler, wherein the estimated temperature of exhaust gas exiting the clean EGR cooler is based on a pre-calibrated coefficient associated with the clean EGR cooler, wherein the pre-calibrated coefficient associated with the clean EGR cooler is determined based on a detected mass flow rate of exhaust gas through the EGR cooler, a detected EGR cooler inlet temperature, and a detected EGR coolant temperature;

wherein the estimated temperature of exhaust gas exiting the fouled EGR cooler is based on a pre-calibrated coefficient associated with the fouled EGR cooler, wherein the pre-calibrated coefficient associated with the fouled EGR cooler is determined based on the detected mass flow rate of exhaust gas through the EGR cooler;

wherein the normalized effectiveness is determined without direct use of the detected mass flow rate of exhaust gas; and wherein an alert is provided to a user based on the determined physical degradation of the EGR cooler.

18. The system of claim 17, wherein the normalized effectiveness comprises a plurality of normalized effectiveness values, and wherein the physical degradation of the EGR cooler corresponds with a center of a distribution curve defined by the plurality of normalized effectiveness values.

* * * * *